US005769424A

United States Patent [19]

Kelly et al.

[11] Patent Number: 5,769,424

[45] Date of Patent: Jun. 23, 1998

[54] ARCADE GAME FOR STACKING DIRECTED PLAYING PIECES

[75] Inventors: Matthew F. Kelly, San Ramon; Bryan M. Kelly, Almo, both of Calif.; J. Richard Oltmann, Scottsdale, Ariz.

[73] Assignee: RLT Acquisition, Inc., Pleasanton, Calif.

[21] Appl. No.: 719,016

[22] Filed: Sep. 24, 1996

[51] Int. Cl.[6] ..... A63D 3/00

[52] U.S. Cl. ..... 273/352

[58] Field of Search ..... 273/352

[56] References Cited

U.S. PATENT DOCUMENTS

| | | | |
|---|---|---|---|
| 1,531,783 | 3/1925 | Hampton . | |
| 1,574,653 | 2/1926 | Holm | 273/124 R |
| 1,879,511 | 9/1932 | Rodgers . | |
| 2,087,198 | 7/1937 | Chambers | 273/110 |
| 2,700,546 | 1/1955 | Glassen, Jr. | 273/102.2 |
| 2,736,559 | 2/1956 | Turner | 273/125 |
| 2,926,915 | 3/1960 | Johns | 273/352 |
| 3,052,472 | 9/1962 | Aumoller | 273/142 |
| 3,275,324 | 9/1966 | Burnside | 273/126 |
| 3,429,574 | 2/1969 | Williams | 273/123 |
| 3,451,680 | 6/1969 | Koleske | 273/118 |
| 3,452,987 | 7/1969 | Di Motta | 273/110 |
| 3,462,149 | 8/1969 | Grusin | 273/113 |
| 3,807,736 | 4/1974 | Goldfarb et al. | 273/122 R |
| 3,851,879 | 12/1974 | Hicks | 273/120 R |
| 4,215,867 | 8/1980 | Natwick | 273/357 |
| 4,216,961 | 8/1980 | McQuillan | 273/89 |
| 4,216,963 | 8/1980 | Boucher | 273/110 |
| 4,397,463 | 8/1983 | Moscovich | 273/1 GE |
| 4,569,522 | 2/1986 | Davies | 273/86 |
| 4,662,846 | 5/1987 | Quercetti | 434/96 |
| 4,772,024 | 9/1988 | Werner | 273/144 B |
| 4,927,160 | 5/1990 | Nichol et al. | 273/371 |
| 4,968,035 | 11/1990 | Furlong | 273/121 R X |
| 5,002,279 | 3/1991 | Kaminkow et al. | 273/119 A |
| 5,066,014 | 11/1991 | Dobson | 273/110 |
| 5,096,192 | 3/1992 | Stanford, Jr. | 273/39 |
| 5,181,722 | 1/1993 | Krutsch et al. | 273/127 B |
| 5,292,127 | 3/1994 | Kelly et al. | 273/118 A |
| 5,318,298 | 6/1994 | Kelly et al. | 273/122 R |

*Primary Examiner*—William H. Grieb
*Attorney, Agent, or Firm*—Hickman Beyer & Weaver, LLP

[57] ABSTRACT

A game method and apparatus includes a playing surface having a player end and a target end and a target provided at the target end. The target includes a channel on a planar target surface that is inclined and receives multiple playing pieces, such as balls, rolled across the playing surface by the player. The channel receives balls in a known configuration, such as a linear stack, such that each additional ball is directed to the channel with greater difficulty by the player due to the presence of previously-directed balls in the stack and rests on the ball immediately preceding it. The channel includes parallel rails for aligning the balls and for preventing the balls from touching the target surface. An aperture collects balls that are not received by the channel and routes the balls to the player. A release device releases the balls from the channel and into the collector. A game score and optional progressive score are based on the positions of balls in the channel.

49 Claims, 6 Drawing Sheets

ARCADE GAME FOR STACKING DIRECTED PLAYING PIECES

BACKGROUND OF THE INVENTION

1. Field of the Invention

This invention relates to games normally played in an arcade environment, and more particularly to such games played by directing a playing piece across a playing surface to a target.

2. Background of the Related Art

Games of many types are played in arcade environments. Redemption games are popular types of arcade games that dispense tickets based on a game score achieved by the player. One popular type of arcade redemption game is commonly referred to as a skee alley game, in which a ball is rolled or bowled by a player across a playing surface to a ramp. The ball is accelerated up into the air and onto a target area, which consists of a number of circular fences of different diameters, each fenced enclosure having an aperture included therein. Each enclosure thus formed is associated with a point score such that enclosures of smaller diameter are worth a higher number of points, A player accumulates a game score by directing balls into the apertures in the circular enclosures.

Games of the prior art such as the skee alley games, while enjoyable, tend to be simplistic and, consequently, can lead to rapid player boredom. This is undesirable in an arcade environment where revenues are directly related to the continuous, repeated use of the games. For example, if a player can consistently direct a ball into the highest scoring target, the player does not face any additional challenges in the game. In addition, a player cannot measure his or her success or progress in the game by viewing previously directed balls, since the balls are immediately removed from the target area.

Furthermore, rolling games of the prior art allow the directed playing pieces to directly strike the target surface, which causes wear and tear on any designs or illustrations provided on the target, and may eventually efface large portions of the target designs.

SUMMARY OF INVENTION

The present invention provides an arcade game for receiving and stacking playing pieces. A player directs multiple successive playing pieces onto a target in a stacked configuration that imposes more difficulty to hit the target with each successively-directed playing piece. This improvement adds excitement and complexity to the game, which tends to prolong player involvement.

More specifically, a game apparatus and method of the present invention includes a playing surface having a player end and a target end and a target provided at the target end. The target receives multiple playing pieces directed by the player, such as balls, in a predetermined configuration such that each additional playing piece is directed to the target with greater difficulty by the player due to the presence of previously-directed playing pieces engaged with the target. Preferably, all the playing pieces received by the target are displayed to the player in the predetermined configuration.

In the preferred embodiment, the target includes a channel having linear guides that receive the playing pieces in a stacked linear configuration. The channel is provided on a planar target surface that is at least partially vertically aligned such that the playing pieces are caused to be stacked on each other due to the influence of gravity when engaged with the channel. Stacked playing pieces are continuously observable by the player. The channel includes two parallel rails for aligning the playing pieces in the stacked configuration and which prevent the playing pieces from touching the target surface. A sensor to detect a playing piece is provided at each playing piece position in the channel. A number of indicators indicate positions in the channel to the player where the playing pieces may be stacked. A collector, such as an aperture in the target surface, is included in the target to receive playing pieces that are not received by the channel.

The playing surface preferably includes a ramp that causes the directed playing pieces to move in a direction against the influence of gravity to engage the channel in the stacked configuration. A player thus directs a playing piece across the playing surface, which then moves up the ramp, into the air, and onto the target surface. The playing piece is received in the channel on top of the stack of playing pieces if the playing piece has a requisite trajectory, which depends on the speed and trajectory or direction of the ball on the playing surface. A return mechanism is included to return the playing pieces to the player end after the playing pieces have been collected by the collector in the target surface. A release device included in the channel releases the playing pieces from the channel and into the return device when the channel is filled with playing pieces. A game score based on the positions of playing pieces in the channel is determined, and a progressive score accumulated over at least one previous game played on the game apparatus or among multiple game apparatuses can also be provided. An award dispenser preferably dispenses an award based upon the final game score.

The game apparatus according to the present invention provides a target that receives directed playing pieces in a predetermined configuration, such as a linear stack of balls. Each successive playing piece is more difficult to direct into the configuration, thus providing an increasing challenge to players based on how well they perform in the game. The playing pieces engaged with the target are preferably observable by the player and other observers so the player can easily and quickly determine his or her progress in the game. These features add complexity and interest to an otherwise simple target rolling game. Player involvement with the game and the revenue produced by the game are thus also putatively increased. Furthermore, the feature of preventing directed playing pieces from touching the target surface saves a great amount of wear and tear on the target and allows visual designs and more delicate devices such as light sources to be placed on the target without concern for those designs and devices being harmed by impacting playing pieces.

These and other advantages of the present invention will become apparent to those skilled in the art after reading the following descriptions and studying the various figures of the drawings.

DETAILED DESCRIPTION OF THE PREFERRED EMBODIMENTS

Figure 1:
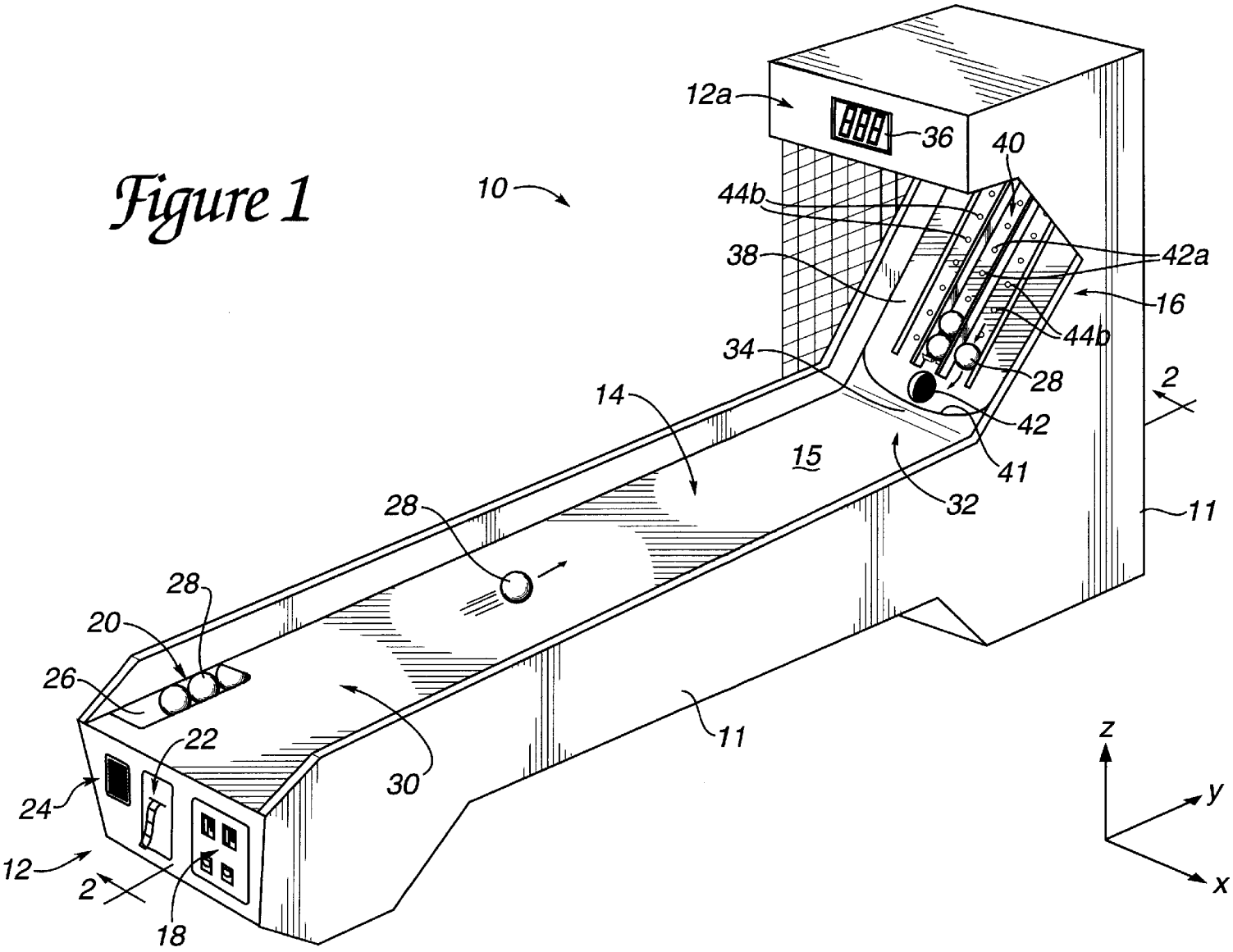
FIG. 1 is a perspective view of a preferred embodiment of the game apparatus of the present invention.

FIG. 1 is a perspective view of a game apparatus in accordance with the present invention. The game apparatus 10 includes a housing 11, front panel section 12, a playing field 14, and a target section 16.

Housing 11 provides support for game apparatus 10 and encloses various game components as described with reference to FIG. 2. The front panel section 12 includes a coin deposit slot and mechanism 18, a playing piece dispenser 20, a ticket dispenser 22, and a speaker 24. Displays or other devices can also be included on front panel section 12 in other embodiments. The front panel section may also include one or more access doors, which can be opened by the operator to access the interior components of the game apparatus.

Coin deposit slot (and associated mechanism) 18 may accept standard currency coins or game tokens that are often available in an arcade environment, or slot 18 may accept other types of monetary or validated input (e.g., dollar bills, debit card, credit card, identification code and/or amount, etc.). A game begins after a coin or token has been inserted by the player and accepted by the coin mechanism. The accepted coin is preferably routed to a cash box or other receptacle. A coin return slot is typically also included to return an inserted coin or token to the player in the event the coin becomes trapped in or rejected by the coin slot mechanism, etc.

Playing piece dispenser 20 provides playing pieces to be used in a game to a player of game apparatus 10. Dispenser 20 is preferably positioned on or near front panel section 12 to allow a player easy access to the playing pieces. In the described embodiment, dispenser 20 is positioned below the surface of playing field 14 and includes an aperture 26 in the playing surface. After inserting a coin or other monetary/validated input, a number of playing pieces are dispensed which the player can retrieve and direct across playing field 14 toward target section 16, as described below. Preferably, the total number of playing pieces are dispensed at the beginning of a game and are held in the player-accessible portion of dispenser 20 for the player. Alternatively, playing pieces can be dispensed to a player sequentially, either one at a time or in groups of any size, up to the maximum number of pieces exchangeable for the player's monetary or validated input. For example, a portion of the playing pieces can be dispensed initially, and an additional playing piece can be dispensed each time a ball is directed into the target section 16. In the preferred embodiment, the playing pieces are balls rolled across playing field 14. In other embodiments, the playing pieces can be discs (e.g., coins), cylinders, or other types and shapes. The playing pieces preferably have similar geometry or shape to each other, but may be different from each other in other embodiments.

Ticket dispenser 22 preferably dispenses a ticket award to the player based upon the result of a game, e.g., typically indicated by a game score. In the described embodiment, tickets may be accumulated to win various prizes. Other types of awards besides tickets can also be dispensed. For example, sports card or other trading cards, toy prizes, other types of vouchers, or coupons, or even coins or currency can be dispensed. Ticket dispensing mechanisms are well-known in the prior art. The awards are stored in a storage area behind the front panel 12 which is described in greater detail with reference to FIG. 2.

Speaker 24 emits sounds based on game actions and other game states and is controlled by the game control system. The operation of the speaker will be discussed in greater detail subsequently. Speaker 24 can be positioned on other areas of game apparatus 10 as well.

Front panel section 12 also can include a game score display 36, which is shown positioned at upper front panel section 12*a* near target section 16 in FIG. 1. Display 36 can also be placed at other areas of the game apparatus. The game score display 36 is preferably a Light Emitting Diode (LED) display that indicates a game score to the player based on the results of a game. Other types of types of displays can also be used, such as a Liquid Crystal Diode (LCD), a Cathode Ray Tube (CRT), etc. An optional progressive score display can also be included in game apparatus 10 on front panel 12*a* or other area. The progressive score displayed by the progressive display can be added to the player's game score on display 36 at the end of game if a progressive goal is achieved. Game score and progressive score are described with reference to FIG. 5. Additional score displays can also be used to provide scores for multiple players of game apparatus 10 or provide visual feedback of other functions during game play.

In alternate embodiments, front panel section 12 can include player controls such as a start button which begins a game. Various other types of buttons, switches, and the like can also be included to allow the player of the game to make various selections concerning game play. For example, a player could select a one- or two-player game, a preferred award type, a progressive option, an end game option, etc., using additional controls on front panel 12.

In addition, in alternate embodiments, a mechanism can be included to allow a player to direct a playing piece down the playing field, such as a spring-loaded or air-compressed "gun," lever, cup or similar launcher which is pivotable and can "shoot" a ball down playing field 14 when the player presses a button or otherwise activates a control device.

Playing field 14 includes a player end 30 and a target end 32. In the preferred embodiment, playing field 14 includes a substantially planar surface 15 that is inclined from a horizontal axis such that player end 30 is slightly lower than target end 32. In the described embodiment, playing field 14 is inclined approximately 5–10 degrees. In other embodiments, more inclination can be added, or the field 14 can be level or inclined such that the player end is higher than the target end.

In the described embodiment, the playing pieces are balls 28 that are directed across the playing surface 15 from the player end 30 to the target end 32 (described in detail subsequently). As referenced herein, the term "ball" refers to any type of approximately spherical object which may have a smooth surface or a surface with indentations, protrusions, etc. In other embodiments, different types of playing pieces can be used, such as cylinders, discs, etc.

The playing surface 15 of playing field 14 is preferably a smooth surface to allow the playing pieces to roll directly across; but it alternatively can be a rough, textured, channeled, or contoured surface that may provide variations to the trajectory of the playing piece. Also, in other embodiments, playing surface 14 can include obstacles, such as apertures, pegs, or other objects, to impede or influence the path of playing pieces that travel across the playing surface.

Figure 2:
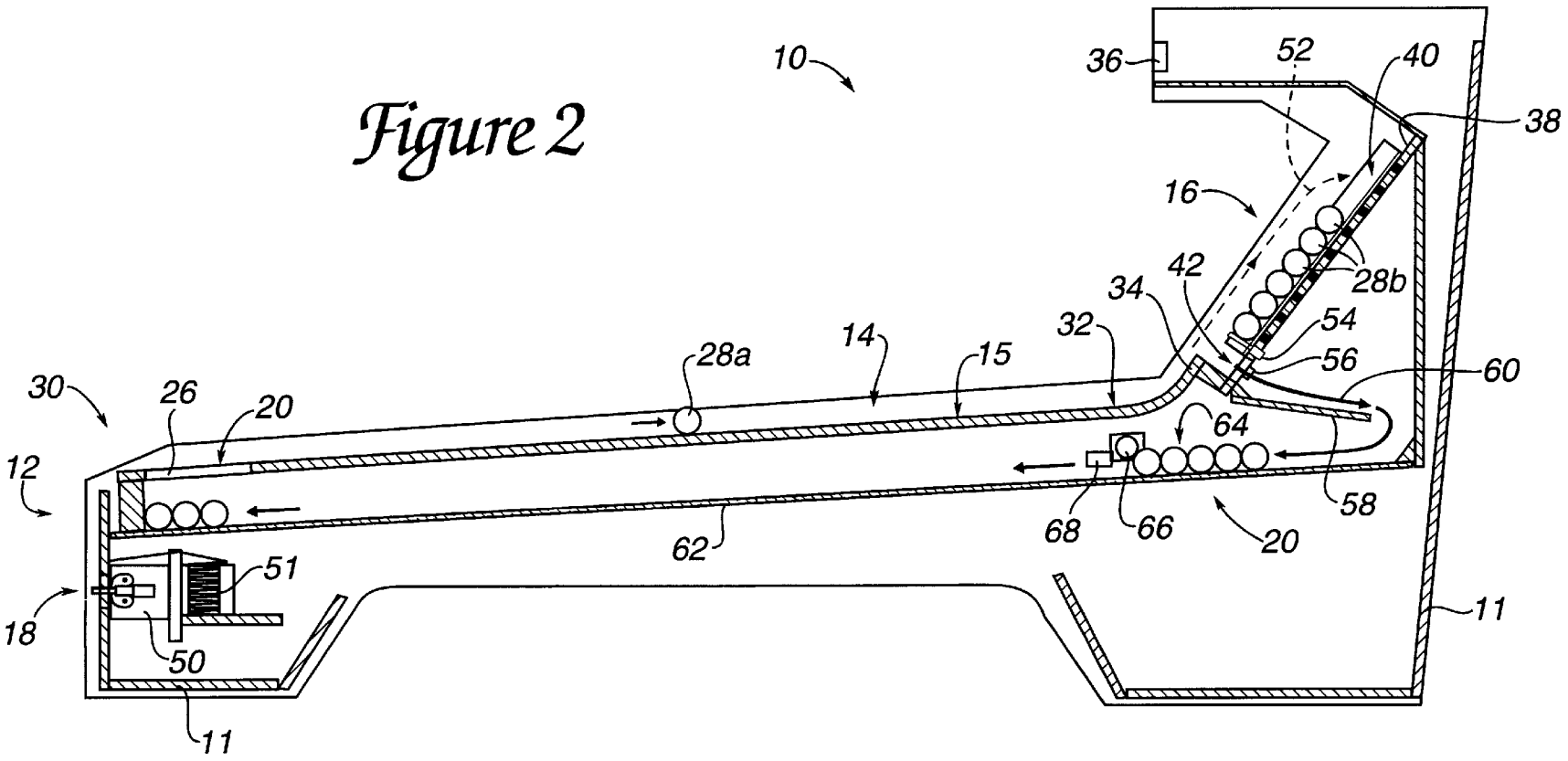
FIG. 2 is a side cross-sectional view of the game apparatus taken along line 2—2 of FIG. 1.

The target end 32 of playing field 14, in the preferred embodiment, includes a ramp 34 which is curved upward (as shown in FIG. 2). A playing piece 28 directed by a player thus rolls across playing field 14 and is directed upward, against the influence of gravity, and toward target section 16 by rolling up and off ramp 34. The trajectory of the ball 28 after it leaves ramp 34 depends on the trajectory of the ball on playing surface 15 and the speed of the ball, i.e., the velocity of the ball on playing surface 15. The higher the speed, the higher the ball will travel upward toward the top of the target field 16. The trajectory and speed of the ball depends on how much force is used in rolling the ball and how accurately the player aims the ball on the playing surface. Thus, the trajectory of the ball after leaving the ramp allows for a wide range of skill from the player to direct the ball at a desired target.

Target section 16 is provided at target end 32 of playing field 14 and receives playing pieces 28 directed by the player. In the described embodiment, target section 16 includes a target surface 38 which is inclined such that the bottom end is closer to the player than the top end of the surface 38 (e.g., 30 degrees from the vertical). As shown in FIG. 1, target surface 38 preferably is parallel to the x-axis of the playing field 14. Target section 16 also includes a central target 40 for which the player is aiming the playing pieces. Central target 40 is preferably a guide such as a channel or slot that is positioned on target surface 38, where the sides of the channel 40 are parallel to the y-z plane. This allows the entire length of channel 40 to be aligned with a linear path of playing piece 28 as it travels down playing field 14. In other embodiments, channel 40 can be positioned in a wide variety of angles or configurations, some of which are described below with reference to FIG. 3. Channel 40 receives playing pieces in a predetermined configuration, as explained below.

A goal of the player playing game apparatus 10 is to direct the playing pieces 28 onto target section 16 so that the playing pieces are received or caught by channel 40. The player must both aim the ball correctly to target the channel 40, and must also provide the correct speed on the playing piece (e.g., by rolling or "bowling" the playing piece with the correct force) so that the playing piece will have the correct trajectory height when leaving ramp 34. A particular range of speeds of the playing piece is sufficient to direct the playing piece onto channel 40.

Each successive playing piece directed by the player is preferably "stacked" on previously-directed playing pieces within channel 40 so that a playing piece in the stack is in contact with the playing pieces above it (if applicable) and below it in the stack, thereby forming a linear stack of playing pieces in channel 40 retained by gravity. Thus, as additional playing pieces 28 are received by channel 40 and the stack grows higher, each successive playing piece must have a slightly higher minimum trajectory height when it leaves ramp 34 to be able to land on, the top of the stack of playing pieces. The first playing pieces in the stack can be directed with a range of speeds, and are easier to direct to the target. However, each additional playing piece in the channel 38 increases the difficulty of directing the next playing piece into the channel, since the range of speeds that will put a playing piece into the channel has diminished. For example, the first playing piece can be directed with a low minimum force (or speed) and the playing piece will have a corresponding low trajectory when it leaves ramp 34. This trajectory is high enough to land at the bottom of the channel 40. The first playing piece can also be directed with a high force or speed, since the playing piece can be received near the top end of channel 40 and roll down to the bottom of the channel. However, once one or more playing pieces are already received by channel 40, successive playing pieces must be directed with a higher minimum force or speed, i.e., a narrower range of acceptable speeds, since lower trajectories will not suffice to cause the channel to receive the ball due to the presence of the previously-directed playing pieces in the channel.

The feature of increasing difficulty for each successive playing piece adds much interest to the game. The increasing difficulty is based on how well the player has already performed in the game, i.e., the difficulty gradually increases as the player directs additional balls into the channel 40. This can provide less frustration and more enjoyment to players since there are no large jumps in difficulty, and also challenges the player incrementally as he or she progresses.

In addition, the player (and other observers) can view previously-directed playing pieces in channel 40. This gives a direct indication to the player as to how well he or she is performing in the game. In addition, since the playing pieces are preferably retained in the channel 40 even when the game is over (as explained below), the player can easily view how well he or she did in the game after directing all the dispensed playing pieces.

Channel 40 can receive a maximum number of playing pieces before there is no longer any channel length to receive additional playing pieces. Preferably, the player is dispensed this maximum number of playing pieces that the channel can hold. Alternatively, a greater number of playing pieces can be dispensed to the player to give the player extra chances to fill the entire channel. Once the player has directed all dispensed playing pieces, the game is over. The playing pieces are eventually released from channel 40 and accumulate in a reservoir from which they can be released to dispenser 20, as described in greater detail below.

Target section 16 also includes an aperture 42 provided in the bottom area of target surface 38. Aperture 42 is provided to collect all playing pieces that do not engage with channel 40. preferably, a rounded lip 41 is provided at the bottom of target surface 38 to guide all non-channel playing pieces to aperture 42. Aperture 42 guides the playing pieces to the reservoir and dispenser 20, as detailed with respect to FIG. 2.

Target section 16 also preferably includes playing piece detection indicators 44. Each indicator 44 is preferably positioned in the middle and on the sides of channel 40. The indicators can "highlight", i.e. visually designate, particular positions along the channel 40 to provide visual feedback to a player concerning which positions currently hold a playing piece and how many positions of the channel are left to fill. The indicators 44 can also be used to direct the attention of the player to a particular position on the channel before that position has received a playing piece. For example, in the preferred embodiment, indicators 44*a* are lights positioned in the center of channel 40 and which designate how many unfilled positions are left. Indicators 44*b* are positioned on the outside of the channel 40 to illuminate the positions that have already been filled by playing pieces. The operation of indicators 44 is described in greater detail with reference to FIG. 3.

The game score display, player control, coin detection, award dispensing, and other functions of the game apparatus are preferably controlled by a control system. This system is described in detail with respect to FIG. 4.

FIG. 2 is a cross-sectional view of the game apparatus 10 taken along line 2—2 of FIG. 1. Game housing 11 supports the front panel 12, playing field 14 and target section 16 and includes a number of interior components.

A player deposits a coin into coin slot 18 in front panel 12. The inserted coin is routed to a cash box 50 which stores accumulated coins that players have deposited. If other monetary input is provided such as from a debit card, then cash box 50 is not necessary. A supply of tickets 51 is also shown behind front panel 12 which can be dispensed based on the game score after a game has been completed. Other types of awards can also be stored similarly.

A number of playing pieces 28, which in the described embodiment are balls, are dispensed after the player provided monetary input. The player can pick up a dispensed ball from dispenser 20 by reaching through dispenser aperture 26 in the playing field 14. The player then directs a ball, such as ball 28*a*, from the player end 30 to the target end 32 of the playing field. The ball moves up ramp 34 and is deflected upward as shown by arrow 52. If the trajectory and speed of the ball is within the correct range, then the ball lands in channel 40 on top of the stack of balls 28*b* that were directed earlier into channel 40 (if any). Indicators 44*a* and 44*b* provide visual feedback to the player concerning the filled positions of the channel 40, and are preferably controlled by a control system as detailed in FIG. 4.

Once the player has directed all the dispensed balls, then the game is over. In the described embodiment, the game apparatus waits for another player to insert a coin before releasing the balls 28*b* from channel 40. The release is accomplished by controlling a stop mechanism 54, which can be a solenoid or other electrical mechanism that is controlled by the control system and which normally supports the stack of balls 28*b*, and which is described with reference to FIG. 3b. A sensor 56 is preferably positioned at aperture 42 to detect when a ball moves through the aperture. For example, an optical sensor can be used, that includes an emitter and detector positioned on each side of aperture 42 such that when a beam of electromagnetic energy from the emitter, such as infrared light, is blocked by a passing ball, the detector senses that the beam is blocked. These types of sensors are well known to those skilled in the art. Alternatively, sensor 56 can be a different type of sensor, such as a Hall effect sensor, motion sensor, photoreflective sensor, etc.

Once a ball passes through aperture 42, it rolls down a ramp 58 which is included in the ball return, as shown by arrow 60. The ball 28 then rolls down the main ball return ramp 62 provided underneath playing field 14. The balls are prevented from rolling down the ramp 62 at a dispenser reservoir 64 by a dispenser mechanism 66. In the described embodiment, dispenser mechanism 66 preferably includes a solenoid that blocks balls from rolling and which can be retracted by the control system to allow balls to roll to the end of ramp 62, where they are accessible to the player through aperture 26. Preferably, a sensor 68 is included to detect when a ball is dispensed to the player. Sensor 68 can be an optical sensor or other type of sensor as described above. In this way, the number of dispensed balls can be counted and the mechanism 66 can be controlled to block any additional balls from being dispensed.

In alternate embodiments, additional features can be added. For example, gutters might be added on either side of playing field 14 which can trap a poorly aimed ball 28 and immediately direct the ball to the ball return.

Figure 3:
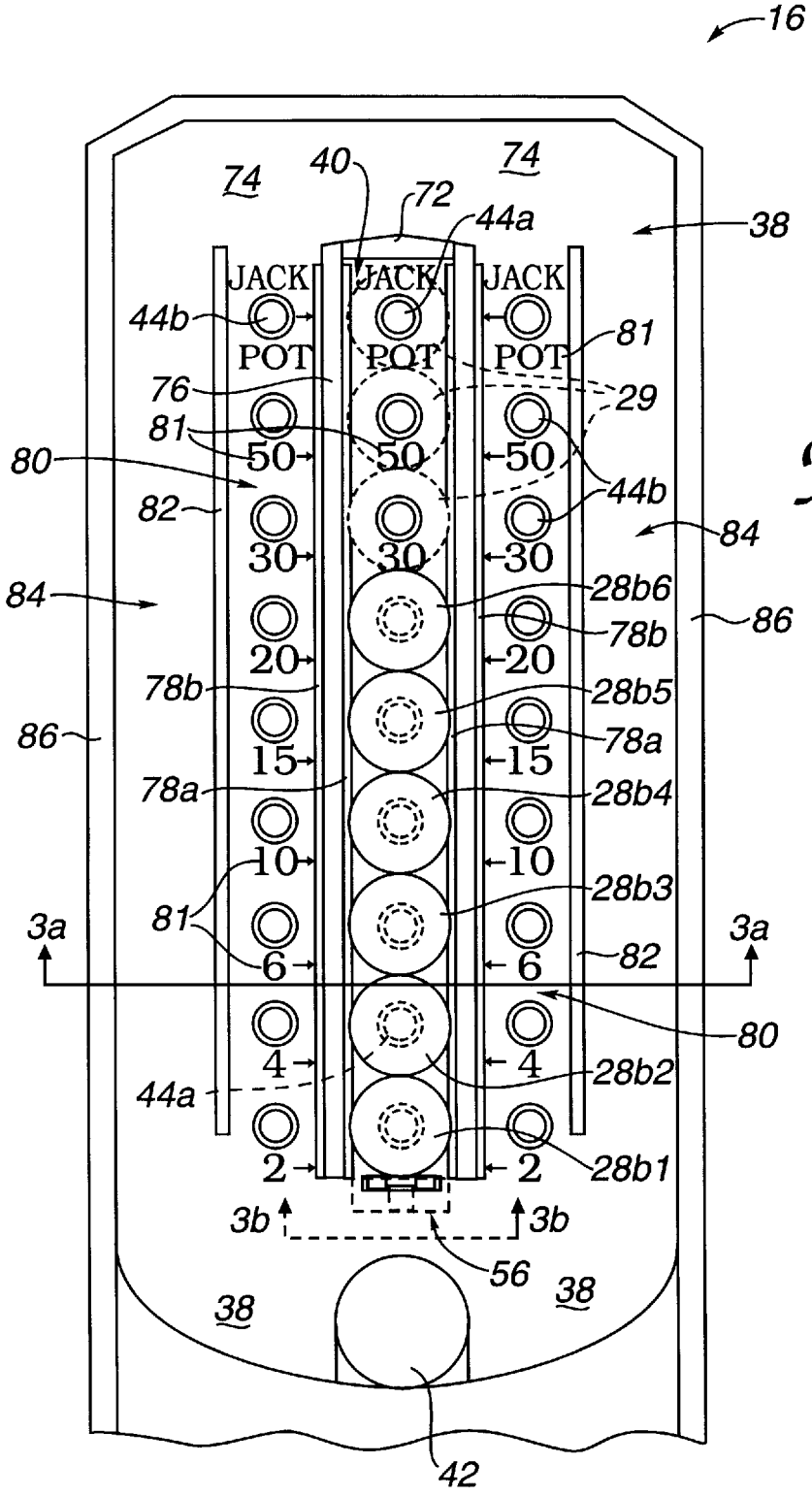
FIG. 3 is a detailed view of the target field of the present invention.

FIG. 3 is a detailed view of a preferred target section 16 of game apparatus 10. Channel 40 is provided in the middle portion of sloped target surface 38. A number of playing piece positions are provided in the channel 40, where a playing piece may fill a position in the channel provided there are playing pieces in the positions below that position (except, of course, for the first bottom position). Thus, in the described embodiment, stack of balls 28b1-28b6 fill the lowest positions in the channel, and the next directed ball is desired to fill the position above ball 28b6. A total of nine positions are provided in the described embodiment, and the three unfilled positions above ball 28b6 are shown with dashed lines 29. In other embodiments, a different number of playing piece positions can be provided in channel 40. Channel 40 preferably includes a sensor at each playing piece position in the channel, as described with respect to FIG. 3*a*.

Channel 40 preferably is capped with an end 72 at the top of the channel. End 72 prevents a ball that has been directed onto the upper area 74 from rolling into channel 40. Thus, the difficulty of aiming a ball into the upper positions of channel 40 (especially the topmost position) is greatly increased when end 72 is provided, since the player must direct a ball into a small area within channel 40. In alternate embodiments, end 72 can be removed, allowing a ball that impacts area 74 to roll into the channel.

Two guide walls 76 are provided to define channel 40. On the inside of walls 76 are rails 78*a* which run about the length of the channel. Rails 78*a* support balls 28*b* in the channel and do not allow the balls to touch the target surface 38. This is described with respect to FIG. 3*a*.

Rails 78*b* are provided on the outside of guide walls 76 and run about the length of the channel 40. In addition, gutter rails 80 are positioned on target surface 38 parallel to guide walls 76 and spaced from the guide walls a distance close to the diameter of a ball 28. Rails 78*b* and gutter rails 80 serve to support balls 28 that do not fall into channel 40. A ball that lands just to the side of channel 40 will be received by a gutter 80 and be supported by a rail 78*b* and associated gutter rail 82 such that the ball does not touch the target surface 38. The ball so supported will then roll down gutter 80 on the supporting rails toward the bottom of target section 16 and fall into aperture 42. In the described embodiment, indicia 81 are provided on target surface 74 in channel 40 and gutter 80 to indicate point values of corresponding positions in the channel 40. Other symbols or artwork can also be placed in gutters 80 and on other areas of the target surface 74.

Similarly, a ball may land on target field 16 further away from channel 40 into an edge gutter 84. With such a landing, the ball is supported by a gutter rail 80 and the closest edge 86 of the target field without touching the target surface 38. The ball rolls down edge gutter 84 toward the bottom of target field 16 and into aperture 42. If the ball lands on a rail 82 or wall 76, the ball will tend to move into the channel or a gutter before rolling down toward aperture 42. Finally, if a ball impacts the upper area 74 above the channel 40, the ball will be guided into one of the gutters 80 or 84 and thus into aperture 42.

Target field 16 also includes a number of indicators 44*a* and 44*b*. Indicators 44*a* are provided in channel 40 and mark the playing piece positions in the channel. Preferably, the indicators are illuminated by a light source (e.g., light bulb(s), LED, etc.) provided in or behind target surface 38, as is well known to those skilled in the art. For example, in the described embodiment, there are nine indicators 44*a* in channel 40 corresponding to the nine positions in the channel. The indicators 44*a* are preferably flush with the target surface 38 and thus can be viewed by the user only when a playing piece is not stacked in the position corresponding to the indicator. Indicators 44*a* that cannot be seen are shown as dashed lines in FIG. 3. Indicators 44*a* are used in the described embodiment to indicate how many positions in channel 40 are unfilled by balls. The player thus can quickly determine his current progress in the game and how close he or she is to achieving a desired goal. Thus, the indicators 44*a* can always be illuminated during a game. Each higher position of channel 40, when filled by a playing piece, preferably providers a greater score to the player, as described in greater detail below.

Indicators 44*b* are provided outside of channel 40 in gutters 80 and can be preferably illuminated similarly to indicators 44*a*.

Indicators 44*b* also correspond to positions in the channel 40 such that two indicators 44*b* are provided on each side of a channel playing piece position. Indicators 44*b* may always be viewed by a player (except when a ball momentarily covers the indicators when rolling toward aperture 42). The indicators 44*b* can be used to indicate, for example, how many positions in the channel 40 have been filled by the stack of playing pieces. For example, in FIG. 3, the bottommost six indicators 44*b* on either side of the channel 40 are illuminated. In alternate embodiments, indicators 44*b* can be used for other purposes. For example, the row of indicators can be illuminated in sequence to provide a moving light display, or specific indicators can be made to blink or illuminate only a specified times, e.g. to indicate how many tickets have been won or can be won. Or, each row of indicators (can indicate a score for a separate player playing the game.

Alternatively, indicators 44*a* and/or 44*b* need not be illuminated, but can be symbols printed, painted, etc. on target surface 38. The indicators 44*a* and/or 44*b* can also be provided as numerals (1, 2, 3, 4, etc.) letters, or other symbols and/or designations.

Target field 16 also includes a stop mechanism 56 positioned at the bottom of channel 40. The stop mechanism prevents the balls 28*b* from rolling out of channel 40 until the control system allows the balls to do so. The stop mechanism is described in greater detail with respect to FIG. 3*b*.

Target field 16 can be configured differently in alternate embodiments. For example, in one embodiment, multiple channels 40 can be included on target surface 38. A player can try to stack up playing pieces in, for example, three separate parallel channels, where each channel may have a separate point score value associated with it depending on how difficult it is to aim a playing piece into the channel due to position, width, length, etc. of the channel. Alternatively, multiple channels can be placed in a line, with more difficult channels higher on the target field 16. In yet other embodiments, channel 40 can be angled, i.e. one end of the channel can be closer to a left edge 86 of the target field 16, while the other end of the channel is closer to the right edge 86. Also, a "Z"-, "S"-, or other shaped channel can be provided to receive playing pieces in a different, predetermined configuration. A moving channel 40 can also be provided to increase the difficulty of the game; for example, the channel can be moved left to right and the right to left in a continuous cycle by motors controlled by the control system. Also, the guide rails defining the channel can be moved closer together and/or farther apart, continuously or intermittently and at different rates, to make a timing decision necessary for the player to place a ball in the channel and thus vary the difficulty of the game. In still other embodiments, additional apertures 42 can be placed at other areas of target surface 38 to receive balls that have not aimed into a desired channel.

Figure 3A:
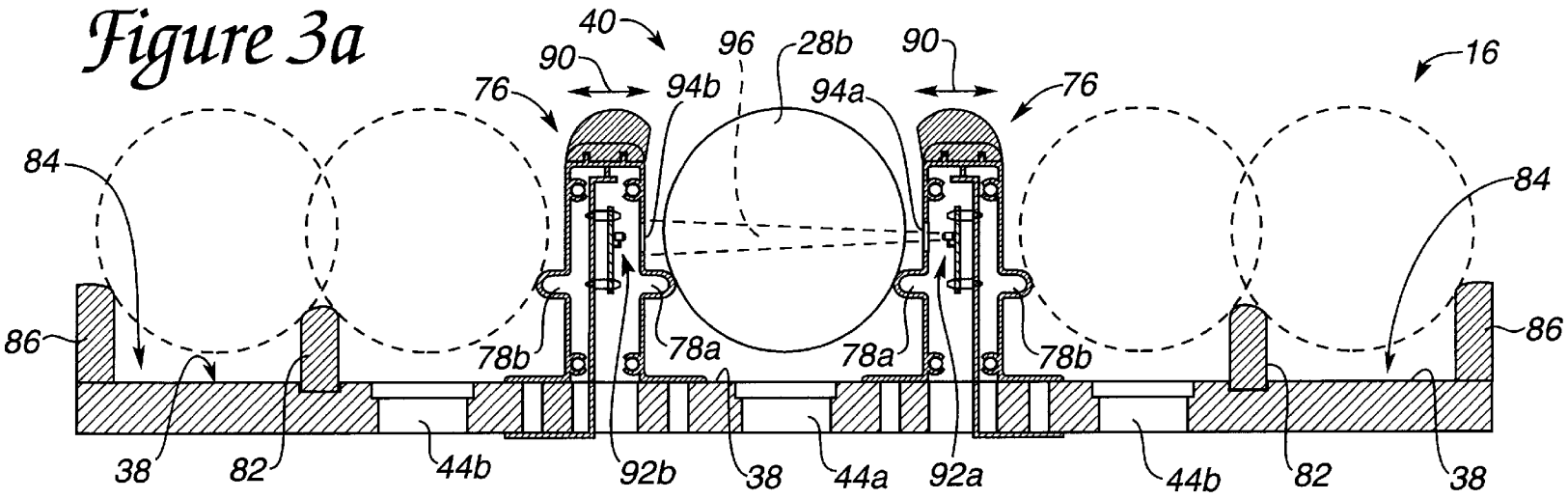
FIG. 3*a* is a side cross-sectional view of the target section and guide rails of the game apparatus.

FIG. 3*a* is a cross-sectional view of the target field 16 taken along line 3*a*—3*a* of FIG. 3. Ball 28*b* is a ball in the stack of playing pieces in channel 40. Ball 28*b* is resting on rails 78*a* so that it does not touch target surface 38. In the preferred embodiment, guide walls 76 can be adjusted in position as shown by arrows 90 to adjust the difficulty of engaging playing pieces in channel 40. For example, guide walls 76 can be moved toward the edges 86 to widen the channel 40, which tends to decrease the difficulty of aiming a ball in the channel. Likewise, one or both walls 76 can be moved closer together to narrow the width of channel 40, which tends to increase the difficulty of engaging a ball with channel 40. Such adjustment can be performed manually (e.g., before a game), or mechanically (e.g., with motors) controlled by the control system.

Gutter rails 82 and edges 86 are shown spaced apart such that a ball 28 (shown in dashed lines) can be supported between wall 76 and gutter rail 82 or between gutter rail 82 and edge 86. Balls so supported do not touch target surface 38. The advantage of the present invention of preventing playing pieces from contacting the target surface 38 is significant in that indicators 44*a* and 44*b* as well as other visual designations, illustrations, and the like can be provided on target surface 38 with no possibility of these visual designations being worn down, damaged, faded, or marred by impacts of playing pieces 28. Since the balls 28 never touch the target surface, the illustrations or indicator device, do not have to be periodically redrawn, replaced, or otherwise maintained by an operator.

Guide walls 76 each preferably include a number of sensors 92 that are positioned within the guide walls. Sensor 92, as mentioned above, is preferably an optical sensor that includes an emitter 92*a* on one side of channel 40 and a detector 92*b* on the other side of the channel. The emitter emits an electromagnetic beam 96 through an aperture 94*a* in guide wall 76, and this beam is detected by detector 92 through an aperture 94*b* in the other guide wall 76 when no playing piece is situated between the emitter and detector. Thus, when the beam is broken by a ball, the detector sends a signal to the control system indicating a ball has been sensed. Preferably, there is a sensor 92 for each position of channel 40. Other types of sensors can also be used.

Figure 3B:
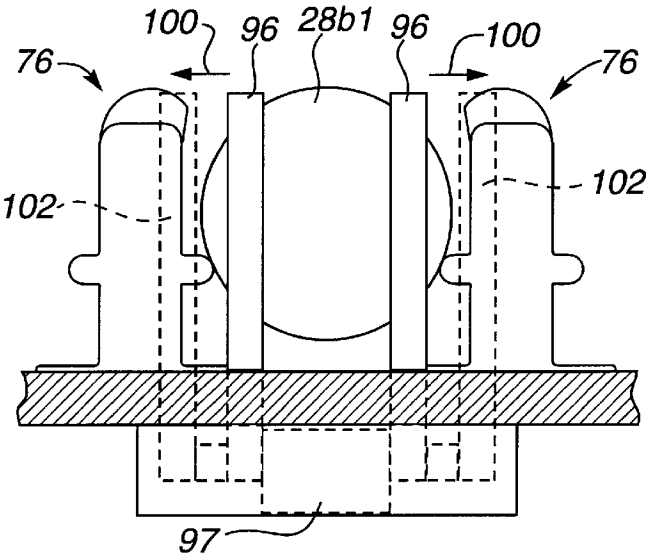
FIG. 3*b* is a side cross-sectional view of the target field and release mechanism of the game apparatus.

FIG. 3*b* is a cross sectional view of the target field 16 taken along line 3*b*—3*b* of FIG. 3. Balls 28*b* are stacked in channel 40 as described previously. Bottommost ball 28*b*1 rests against stop mechanism 56, which is coupled to the control system detailed in FIG. 4. In the described embodiment, stop mechanism 56 includes two spring-loaded stop members 96 which are translatable by a motor or solenoid 97. In the stop position, as shown, balls 28*b* are prevented from rolling out of channel 40. The control system can signal the solenoid to translate stop members 96 in the direction shown by arrow 100 to a release position 102 (shown in dashed lines), thus widening the gap between the stop members 96. Balls 28*b* are then able to roll out of channel 40 and into aperture 42. Once no balls 28*b* are sensed in channel 40, the control system signals the stop members 96 to move back into the stop position. Alternatively, one or more of the stop members can be pivotable to one side to widen the gap and allow the balls to roll out of the channel. In yet other embodiments, a stop can be retracted or otherwise moved to allow the balls 28*b* to roll down target surface 38 into aperture 42.

Figure 4:
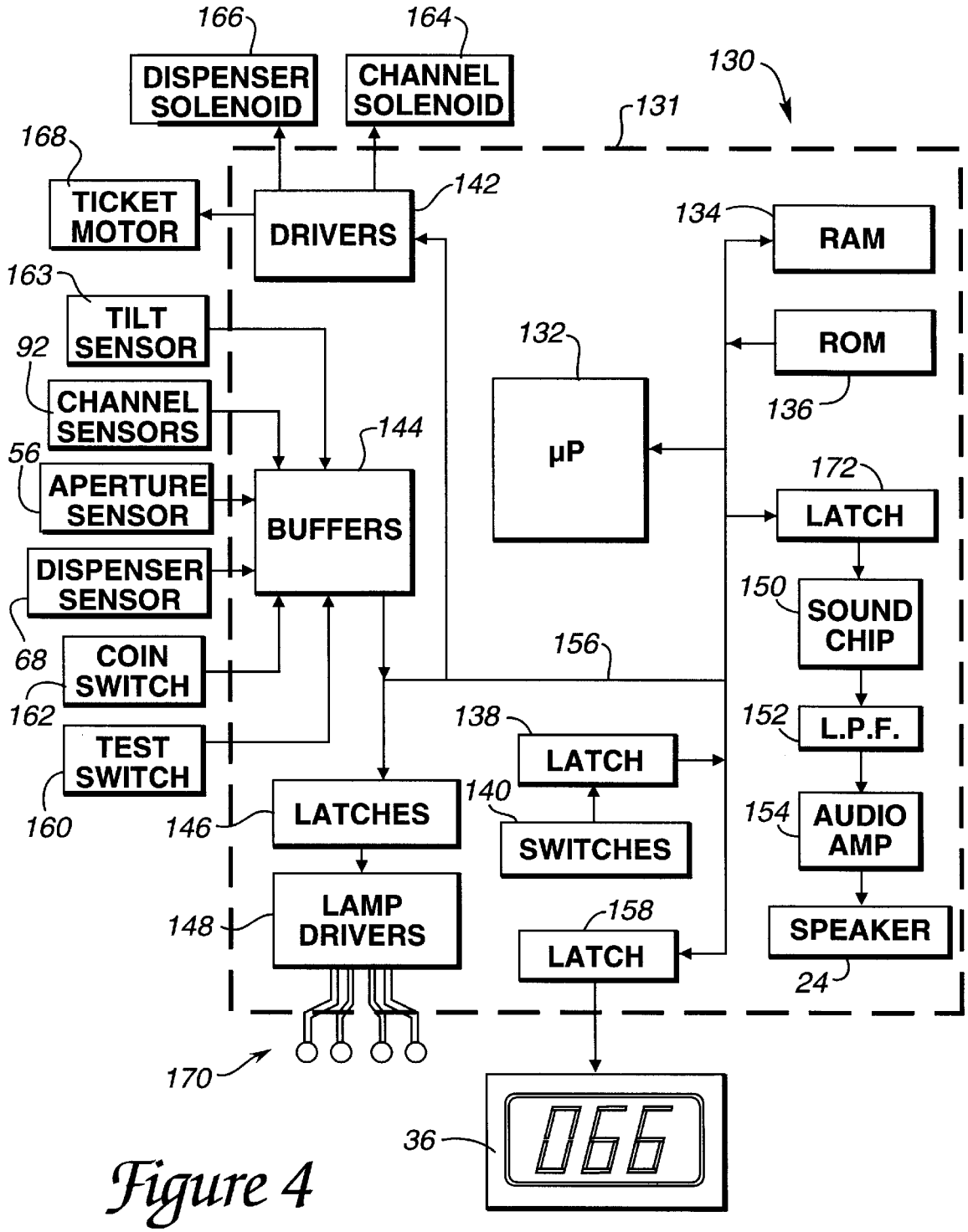
FIG. 4 is a block diagram of an example of an electronic control system of the game apparatus.

FIG. 4 is a block diagram of a control system 130 of game apparatus 10. The control system, for example, can be implemented on one or more printed circuit boards 131 which can be located in the interior of game apparatus 10, for example, on a side in the interior of the game apparatus. The components of control system 130 include a microprocessor 132, random access memory (RAM) 134, read-only memory (ROM) 136, a latch 138, DIP switches 140, a game score display 36, drivers 142, buffers 144, latches 146, lamp drivers 148, sound chip 150, low pass filter 152, audio amplifier 154, and speaker 24.

Microprocessor 132 controls the operations of game apparatus 10. A suitable microprocessor is an 8-bit microprocessor, such as the Intel 8031, which has the range of features adequate for the task, including eight data lines and sixteen address lines. The microprocessor preferably executes software instructions that can be stored in memory. Processor 132 is coupled to ROM 136 by a data/address/control bus 156. The ROM 136 is preferably an erasable, programmable read-only memory (EPROM) that contains the start-up instructions and operating system for the microprocessor 132. Microprocessor 132 is connected to RAM 134 by bus 156 to permit the use of RAM for scratch-pad memory. Methods for coupling ROM 136 and RAM 134 to the microprocessor 132 by bus 156 including enable, address, and control lines are well-known to those skilled in the art.

The microprocessor 132 is also coupled to a latch 138 by the bus 156. The switches 140 coupled to latch 138 provide selectable game functions that the operator of the game unit may change to his or her liking. These selectable functions can include the amount the score is incremented when a playing piece engages a particular position of channel 40, the amount of tickets dispensed based on the score, the amount of playing pieces dispensed to the player for each game, the conditions required to add to the game score and/or receive an award, multi-player options, the conditions required for a player to win a progressive bonus, etc. These factors can affect the difficulty of the game and the amount of awards received by players. Other functions selectable by switches 140 can include sound effects, the test mode, the type of game, and so on, depending on how many selectable functions are desired. Switches 140 can, for example, be implemented as DIP switches. Alternatively, the functions selected by switches 140 can be selected from another input device, such as a control panel or keyboard of buttons, or through software commands to the microprocessor 132.

Microprocessor 132 is also coupled to score display 36. The bus 156 connecting the microprocessor 132 to the score display 36 is latched by a latch 158. The score display can be a 7-segment LED digit display or similar display.

Microprocessor 132 is also coupled to drivers 142 and buffers 144. Buffers 144 receive data from several switches and sensors, including test switch 160, coin slot switch 162, tilt sensor 168, dispenser sensor 68, aperture sensor 56, and channel sensors 92. Test switch 160 can be a switch accessible to the operator which activates a test mode for the game apparatus 10 to determine if the game is operating correctly. Coin slot switch 162 detects when a coin has been inserted into coin slot 18 of the game apparatus (or other monetary input). Tilt sensor 163 detects when the entire game apparatus 10 is moved or tilted past a desired level so that a game in progress can be stopped. Dispenser sensor 68 detects when a playing piece has been dispensed to the player. Aperture sensor 56 detects any playing pieces 28 that have fallen into aperture 42 (including when the balls in channel 40 are released). Channel sensors 92 detect the presence of playing pieces at the positions of the channel 40.

Drivers 142 activate and drive output devices including channel solenoid 164 of stop mechanism 56 for releasing playing pieces from channel 40, dispenser solenoid 166 for releasing playing pieces to the player, and ticket motor 168 for dispensing an award from award dispenser 22.

The microprocessor 132 is also coupled to latches 146 which latch data for the lamp drivers 148. The lamp drivers 148 supply power to the lamps 170, which include, for example, light sources for illuminating indicators 44. Lamps 170 can also include additional lamps provided on or around the perimeter of front panel 12, playing field 14, and other areas of game apparatus 10 which can be highlighted as part of game action.

The microprocessor 132 is also coupled to a sound chip 150 which can be, for example, an OKI Voice Synthesis LSI chip available from OKI Semiconductor of San Jose, Calif. that has eight data input lines coupled to the microprocessor 132 by a latch 172. The sound chip 150 can receive its data from ROMs (not shown) and preferably outputs sound data to a low pass filter 152, an audio power amplifier 154, and finally to the output speaker(s) 24, which generate sounds to the player playing the game apparatus 10, as is well known to those skilled in the art.

The preferred embodiment of the control system 130 operates briefly as follows. The microprocessor 132 first reads the low memory from ROM 136 over bus 156 and sequences through the software instructions stored in ROM. The settings of switches in the switches block 140 are also read into the microprocessor. The software from the ROM 136 then instructs microprocessor 132 to send and receive data over bus 156 in order to wait for a game to begin and to conduct a game. For example, when the coin slot switch 162 is activated, indicating a coin has been inserted into coin slot 18, the microprocessor receives a signal from buffers 144 on bus 156. The microprocessor sends signals to the drivers 142 over bus 156 to control channel solenoid 164 to release playing pieces and dispenser solenoid 166 to dispense playing pieces. Dispenser sensor 68 indicates the number of playing pieces dispensed. The microprocessor reads information from channel sensors 92 and aperture sensor 56 to determine the positions of playing pieces to calculate game score. During game play, the microprocessor sends appropriate output signals over bus 156 to update game score display 36 and activate speaker 24 and lamps 170. Once the game is over, microprocessor 132 controls ticket motor 168 to dispense a number of tickets or other awards based on game score. The method of operation of the preferred embodiment of the game apparatus is described in with respect to FIG. 5.

Figure 5:
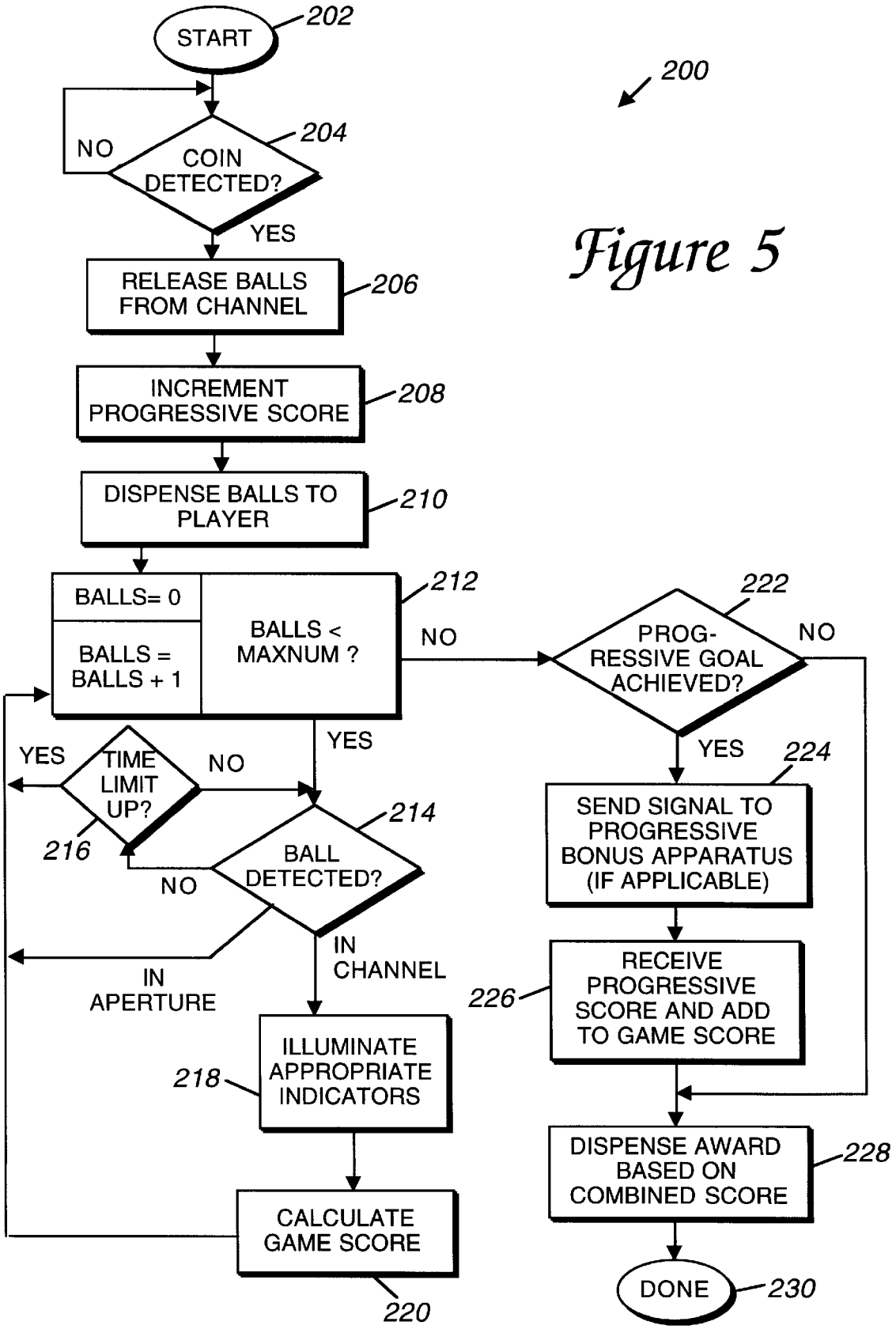
FIG. 5 is a flow diagram illustrating a method of playing and operating the game apparatus of FIG. 1.

FIG. 5 is a flow diagram illustrating a method 200 of operating and playing the described embodiment of game apparatus 10. The process begins at 202. In step 204, the microprocessor checks if a coin (or other monetary input) has been inserted into coin slot 18 by checking a signal from coin slot switch 162. If no coin is detected, step 204 is repeated until a coin is detected. In step 206, the balls **28*b* (or other playing pieces) are released from the channel, causing the balls to roll into aperture 42 and dispenser 20**.

In step 208, the progressive score is incremented by a predetermined amount and displayed on a score display if a progressive score is being implemented. Alternatively, the progressive score can be automatically incremented over time at regular or random intervals, incremented based on other criteria such as goals achieved during a game, manually incremented by an operator, etc. An individual progressive score is a score that is accumulated over current and previous games and is added to the game score if a progressive goal is achieved during a game. In some embodiments, an "individual progressive score" is accumulated from contributions from a single game apparatus 10. In other embodiments, multiple game apparatuses 10 can all be linked to a separate progressive bonus apparatus. Each individual game apparatus contributes to a "collective progressive score" that is stored and displayed by the separate bonus apparatus (the progressive display of individual game apparatus 10 can also display a collective progressive score). The collective progressive score can be awarded to the first player of a linked game apparatus to achieve a progressive goal. Progressive goals, scores, and bonus apparatuses are described in greater detail in U.S. Pat. No. 5,292,127, by Kelly et al., entitled "Arcade Game", which is hereby incorporated by reference herein.

If a multi-game system with a separate progressive bonus apparatus is being used (i.e., a collective progressive bonus), the microprocessor 132 can send a signal to the progressive bonus apparatus in step 208 to increment a collective progressive score and receive an updated progressive score signal from the bonus apparatus (or can receive this signal is step 226 below). The microprocessor can receive an updated progressive score signal from a connected bonus apparatus any time during process 200 or even when a game is not being played, since players on other game apparatuses connected to the bonus apparatus can contribute to the collective progressive score at any time.

In step 210, process dispenses a number of balls to the player. In the preferred embodiment, the number of dispensed balls equals the number of ball positions of channel 40. In other embodiments, a different number of balls may be selected by the operator to be dispensed, as described above. In step 212, the variable BALLS is initialized to zero and the microprocessor checks if BALLS is less than MAXNUM, which is the number of balls dispensed to the player in step 210. All indicators 44 can also be reset to a beginning game state if any are illuminated differently from a previous game.

If BALLS is less than MAXNUM, then step 214 is performed, where microprocessor 132 checks if a ball has been detected by the channel sensors 92 or by aperture sensor 56. If not, then in step 216, the processor checks whether a time limit has expired. In some embodiments of the game apparatus 10, if the player does not direct a ball within a predetermined time limit (such as 20 seconds) from the previous ball or from the insertion of monetary input, then the process counts another ball as having been thrown. Accordingly, the process returns to step 212 to increment the variable BALLS. Optionally, the game can automatically end if a ball is not detected within a predetermined time limit after inserting a coin. If the time limit is not expired in step 216, the process returns to step 214 to await detection of a ball.

If a ball has been detected in aperture 42 by aperture sensor 56, then the process returns to step 212 to increment the variable BALLS and check if BALLS is greater than or equal to MAXNUM. If a ball has been detected in channel 40 by a channel sensor 92, then the process continues to step 218, where the appropriate indicators 44*a* and/or 44*b* are illuminated according to the position of the newly-detected ball. For example, the indicators 44*b* corresponding to the position of the newly-detected ball can be changed from a non-illuminated state to an illuminated state. Alternatively, no indicators 44 need be highlighted in process 200. Step 220 is then implemented, in which the game score is adjusted in accordance with the newly-detected ball.

Game score can be determined in a variety of ways. For example, the nine ball positions in channel 40 in the described embodiment can each have a point total associated with it, such that position 1=10 points, position 2=20 points, position 3=30 points, and so on, and where the point total for each position is added to the game score. Thus, if a player aims balls into all nine channel positions, the score is $9!\times10=450$ points. Alternatively, the point values can increase more dramatically (e.g., exponentially or according to a geometric series) for the higher positions of the channel, with the highest position providing an extremely high score to reflect the difficulty of aiming a ball there. For example, the positions can be worth 2, 4, 6, 10, 15, 20, 30, 50, and "jackpot" points (and/or tickets), in order from lowest to highest (where the "jackpot" is a progressive goal). A ball falling in aperture 42 is preferably worth zero points, but can affect game score in other embodiments (e.g., subtract from game score by a predetermined amount).

In other embodiments, particular indicators 44 can, be illuminated to highlight specific positions in channel 40 as "scoring positions" which may increase the game score if a ball is received by those positions, or which may increase the game score by a much greater amount than other. non-scoring apertures. In embodiments having multiple channels 40 on target section 16, indicators 44 in particular channels can be highlighted to indicate a goal for the player. Or, a progressive goal can be similarly designated by indicators 44. Also, the amount of score adjustment can be displayed as a number near each channel position, or be a constant or random amount. After step 220, the process returns to step 212 to increment the variable BALLS and to compare BALLS to MAXNUM.

Once the variable BALLS is greater than or equal to MAXNUM in step 212, then the game is effectively over for the player. Step 222 is then performed, in which the microprocessor checks if a progressive goal was achieved by the player during the game. A progressive goal is achieved in the described embodiment when the player fills all the positions of channel 40 with balls. Alternatively, other progressive goals can be designated, such as aiming a ball into a particular positions in channel 40 or achieving a predetermined minimum score. In addition, different goals can be designated for an individual progressive bonus and for a collective progressive bonus.

If the progressive goal was not achieved by the player, the process continues to step 228, detailed below. If a progressive goal was achieved by a player of game apparatus 10, then, in step 224, a signal is sent to the progressive bonus apparatus (if a collective progressive bonus is implemented) which indicates that the progressive goal has been achieved and includes the identity of the winning individual game apparatus 10. In step 226, the (winning) game apparatus 10 receives the progressive score amount and this progressive score is added to the game score of the individual game apparatus 10 to equal a combined score.

If an individual progressive score is implemented, then in place of steps 224 and 226, the progressive score accumulated on the individual game apparatus 10 is added to the game score to result in the combined score.

Alternatively, steps 224 and 226 can be implemented after step 220 after each ball is detected in channel 40 of the game apparatus. In such an embodiment, the player could receive a progressive bonus score after directing a ball into a particular position in the channel associated with a progressive score.

In next step 228, an award based on the combined game score (as modified by step 226) is dispensed to the player from award dispenser 22. For example, one award ticket can be dispensed for each point of game score. Alternatively, one award ticket can be dispensed for every X scored points; for example, X=10. Alternatively, an operator of the game apparatus can manually provide an award to the winning player based upon the game score. The game process is then complete as indicated at 230. The process can also return to step 204 to wait for another coin to be inserted in coin slot 18.

In other embodiments, an award from dispenser 22 can be dispensed at different times during the game process 200. For example, an award based on the game score can be dispensed to the player after each new ball is detected in channel 40. In those embodiments which do not include a progressive score or a progressive bonus apparatus, steps 224 and 226 can be omitted.

In yet other embodiments, multiple coins (or monetary value for multiple games) can be inserted by the player to adjust the amount of tickets or awards won. For example, 3 coins inserted can cause the final game score to be multiplied by 3 and provide the player with the resulting number of tickets. In other embodiments, the player can be allowed to continue a game when the game is over by inserting additional monetary value into coin slot 18. For example, the player can buy extra balls or playing pieces and continue to direct them towards target 16 and adjust the game score achieved during the previous game.

While this invention has been described in terms of several preferred embodiments, it is contemplated that alterations, modifications and permutations thereof will become apparent to those skilled in the art upon a reading of the specification and study of the drawings It is therefore intended that the following claims include all such alterations, modifications and permutations as fall within the spirit and scope of the present invention.

What is claimed is:

1. A game apparatus providing a game, said game apparatus comprising:

a playing surface having a player end and a target end;

a target provided near said target end of said playing surface, said target being operative to simultaneously engage a plurality of playing pieces directed from said player end to said target end by said player during said game, said target receiving said playing pieces in a predetermined configuration that causes each additional playing piece to be engaged with said target with greater difficulty by said player due to the presence of previously-directed playing pieces engaged with said target; and a detection device provided at said target, wherein said detection device detects the number of said directed playing pieces engaged with said target.

2. A game apparatus as recited in claim 1 wherein said target is receptive to a predetermined number of playing pieces such that when said detection device detects that said predetermined number of playing pieces have been engaged with said target, said game is automatically ended and said target is cleared of said playing pieces.

3. A game apparatus as recited in claim 2 wherein said target is at least partially vertically aligned such that said playing pieces are caused to be stacked on each other due to the influence of gravity when engaged with said target.

4. A game apparatus as recited in claim 3 wherein said target includes a channel having two parallel rails for aligning said playing pieces in said stacked configuration, said parallel guides supporting engaged playing pieces over a target surface that supports said guides such that said playing pieces engaged with said target do not contact said target surface.

5. A game apparatus as recited in claim 3 further comprising a ramp that causes said directed playing pieces to move off said playing surface in a direction against said influence of gravity approximately over at least a portion of said target before engaging said target in said stacked configuration.

6. A game apparatus as recited in claim 3 further comprising indicators operative to indicate to said player positions of said target where said playing pieces may engage said target.

7. A game apparatus as recited in claim 1 further comprising a return mechanism operative to return said playing pieces to said player end after said playing pieces have been directed by said player.

8. A game apparatus as recited in claim 7 wherein said return mechanism includes an aperture in said target into which said playing pieces may fall when said playing pieces do not engage said target and when said playing pieces are released from said target.

9. A game apparatus as recited in claim 7 further comprising a release device operative to release said playing pieces from said target and into said return mechanism when a predetermined number of playing pieces has been engaged with said target.

10. A game apparatus as recited in claim 9 wherein said playing pieces are automatically released into a collector by said release device at a beginning of a next game played on said game apparatus.

11. A game apparatus as recited in claim 1 wherein said detection device includes a plurality of sensors, each of said sensors provided at a position on said target where a playing piece may engage said target.

12. A game apparatus as recited in claim 5 wherein said playing pieces are substantially spherical, and wherein said ramp is positioned such that it vaults said playing pieces off said playing surface and into the air such that said playing pieces impact either said target or a target surface that supports said target, wherein said playing pieces roll into a collection aperture after said impact when impacting said target surface.

13. A game apparatus as recited in claim 11 further comprising a digital controller operative to control operations of said game apparatus.

14. A game apparatus as recited in claim 12 wherein said target includes a channel for receiving said pieces in said predetermined configuration, wherein said channel is blocked at a top of said channel to prevent playing pieces from rolling into said channel after impacting said target surface.

15. A game apparatus as recited in claim 1 further comprising a scoring apparatus for accumulating a game score based on said playing pieces engaged with said target and a progressive score, said progressive score being accumulated over at least one previous game played on said game apparatus.

16. A game apparatus comprising:

a playing surface having a player end and a target end;

a target provided at said target end of said playing surface, said target being receptive to a plurality of playing pieces directed by a player on said playing surface from said platter end to said target end, wherein said target includes a guide which supports said playing pieces above said playing surface at said target end such that said playing pieces engage said target without touching said playing surface at said target end, and wherein playing pieces received by said target are displayed to said player as engaged with said target and arranged in a predetermined configuration; and a collector provided at said target end and receptive to said plurality of playing pieces that are not received by said target, wherein playing pieces received by said collector are not displayed to said player.

17. A game apparatus as recited in claim 16 wherein said playing pieces are balls.

18. A game apparatus as recited in claim 17 further comprising a ball return that is coupled to said collector.

19. A game apparatus as recited in claim 18 wherein said collector includes an aperture provided in a surface at said target end, wherein said aperture guides playing pieces to said ball return and said ball return guides said playing pieces to said player end of said playing surface.

20. A game apparatus as recited in claim 16 wherein said target and said collector are provided on a planar target surface provided at said target end, and wherein said guide includes a plurality of linear guides provided on said planar target surface wherein said playing pieces engage said linear guides in a linear configuration.

21. A game apparatus as recited in claim 20 wherein said planar target surface is tilted and wherein said linear guides are arranged such that said playing pieces engaged with said linear guides are caused to be stacked on each other due to the influence of gravity when engaged with said target.

22. A game apparatus as recited in claim 21 wherein said playing surface includes a ramp for causing said directed playing pieces to move in a direction against said influence of gravity to allow said playing pieces to engage said guides in a stacked configuration.

23. A game apparatus as recited in claim 16 further comprising a release device operative to release said playing pieces from said target and into said collector when a predetermined number of playing pieces has been engaged with said target.

24. A game apparatus as recited in claim 23 further comprising a playing piece sensor coupled to said target operative to sense the number of playing pieces engaged with said target.

25. An apparatus for playing a game, the apparatus comprising:

target means for simultaneously engaging a plurality of playing pieces directed by a player, said target means receiving said playing pieces in a plurality of positions in a predetermined linear configuration that is displayed to said player and that causes said player to engage each additional playing piece with said target means with greater difficulty due to the presence of previously-directed playing pieces engaged with said target means;

means for directing said plurality of playing pieces from said player to said target means;

means for sensing said playing pieces engaged with said target at each of said positions of said target means;

means for determining when a game is over so that no additional playing pieces are sensed at said target means during said game; and means for returning said directed playing pieces to said player.

26. An apparatus as recited in claim 25 wherein said means for returning said directed playing pieces includes:

means for automatically releasing said playing pieces engaged with said target means after said game is over; and an aperture operative to receive said playing pieces that are released from said target means and said playing pieces that do not engage said target means, and operative to return said playing pieces received in said aperture to said player.

27. An apparatus as recited in claim 26 further comprising:

means for receiving monetary input to said apparatus;

means for adjusting a game score in accordance with a number of playing pieces engaged with said target; and means for dispensing a number of tickets based upon said game score.

28. A method for implementing a game, comprising:

providing a playing surface and a target at one end of said playing surface;

receiving a first ball on said playing surface, said first ball being directed by a player towards said target;

receiving said first ball at said target in a first position of said target if said first ball has a requisite trajectory, wherein said first ball remains engaged with said target and is observable by said player;

detecting said first ball at said first position with a first sensor device when said first ball is engaged with said target;

receiving a second ball on said playing surface, said second ball being directed by said player towards said target;

receiving said second ball at said target in a second position of said target and engaged with said first ball if said second ball has a requisite trajectory; and detecting said second ball at said second position with a second sensor device when said second ball is engaged with said target.

29. A method as recited in claim 28 wherein said target receives said first ball and said second ball on a linear guide such that said first and second balls do not touch a surface supporting said linear guide when engaged with said target.

30. A method as recited in claim 28 wherein said first and second balls are directed against the influence of gravity off of a raised end of said playing surface such that said balls may land on said target, wherein said requisite trajectories of said first ball and said second ball after said balls leave said raised end of said playing surface are dependent on a speed and trajectory of said ball on said playing surface.

31. A method as recited in claim 28 further comprising collecting balls not having said requisite trajectory and said balls engaged with said target, and detecting with a sensing apparatus whether a predetermined number balls in a game have been directed by a player.

32. A method as recited in claim 30 wherein said balls are arranged in a linear stacked configuration within a channel on said target.

33. A method as recited in claim 28 further comprising receiving a plurality of additional balls directed by said player on said target such that said first ball, second ball, and additional balls are arranged in said linear stacked configuration.

34. A method as recited in claim 33 further comprising releasing said balls from said target if a predetermined number of balls are engaged with said target.

35. A method as recited in claim 34 further comprising receiving monetary input to begin a game, and releasing balls directed from a previous game from said target after said monetary input is received.

36. A method as recited in claim 33 further comprising providing a game score based on said number of balls received by said target.

37. A method as recited in claim 36 further comprising contributing to a progressive score and adding said progressive score to said game score when said player achieves a progressive goal, wherein said progressive goal includes engaging a predetermined number of balls in said stacked configuration on said target.

38. A game apparatus comprising:

a playing surface having a player end and a target end;

a target provided at said target end of said playing surface, said target being operative to simultaneously engage a plurality of playing pieces directed from said player end to said target end by a player, said target receiving said playing pieces in a predetermined configuration that causes each additional playing piece to be engaged with said target with greater difficulty by said player due to the presence of previously-directed playing pieces engaged with said target; and a plurality of sensors, each of said sensors provided at a corresponding position on said target where a playing piece may engage said target, said sensors detecting a presence of a playing piece engaged with said target at said corresponding position.

39. A game apparatus as recited in claim 38 wherein said target includes a channel having two parallel rails for aligning said playing pieces in a stacked configuration, wherein said parallel rails support said playing pieces above said playing surface.

40. A game apparatus as recited in claim 39 wherein said playing surface includes a ramp that causes said directed playing pieces to move in a direction against said influence of gravity to engage said target in said stacked configuration.

41. A game apparatus as recited in claim 38 further comprising a return mechanism operative to return said playing pieces to said player end after said playing pieces have been directed by said player, wherein said return mechanism includes an aperture in said target into which said playing pieces may fall.

42. A game apparatus as recited in claim 38 further comprising a scoring device for determining a game score based on positions of said target engaged by said playing pieces, wherein positions which are engaged with greater difficulty contribute a greater amount to said game score.

43. A game apparatus comprising:

a playing surface having a player end and a target end;

a target provided at said target end of said playing surface, said target being receptive to a plurality of playing pieces directed by a player on said playing surface from said player end to said target end, wherein said target includes a plurality of linear guides which support said playing pieces above said playing surface at said target end such that said playing pieces engage said target without contacting said playing surface at said target end, and wherein playing pieces received by said target are displayed to said player as engaged with said target and arranged in a linear configuration.

44. A game apparatus as recited in claim 43 further comprising a collector provided at said target end and receptive to said plurality of playing pieces that are not received by said target, wherein playing pieces received by said collector are not displayed to said player.

45. A game apparatus as recited in claim 44 further comprising linear gutter rails positioned approximately parallel to said linear guides and receiving playing pieces that do not engage said target, said gutter rails preventing said playing pieces from contacing said playing surface at said target end and guiding said playing pieces to said collector.

46. A game apparatus as recited in claim 45 wherein said playing surface is planar at said target end, wherein said planar target end is tilted and wherein said linear guides are arranged such that said playing pieces engaged with said linear guides are caused to be stacked on each other due to the influence of gravity when engaged with said target.

47. A game apparatus as recited in claim 46 wherein said playing surface includes a ramp for causing said directed playing pieces to move in a direction against said influence of gravity when directed towards said target by said player to allow said playing pieces to engage said guides in a stacked configuration.

48. A method for implementing a game, comprising:

providing a playing surface and a target at one end of said playing surface;

receiving a first ball on said playing surface, said first ball being directed by a player towards said target;

receiving said first ball on a linear guide of said target if said first ball has a requisite trajectory, wherein said first ball remains engaged with said target and is observable by said player and wherein said first ball does not touch a surface supporting said linear guide when engaged with said target;

receiving a second ball on said playing surface, said second ball being directed by said player towards said target; and receiving said second ball on a linear guide of said target and engaged with said first ball if said second ball has a requisite trajectory, wherein said second ball remains engaged with said target and is observable by said player, and wherein said second ball does not touch a surface supporting said linear guide when engaged with said target.

49. A game apparatus comprising:

a playing surface having a player end and a target end;

a ramp provided at said target end of said playing surface, said ramp causing a playing piece directed from said player end to said target end to move off said playing surface in a direction against said influence of gravity; and a target provided near said target end of said playing surface, said target receiving said playing piece that has moved off said playing surface, said target being operative to simultaneously engage a plurality of playing pieces directed from said player end to said target end by a player, said target receiving said playing pieces in a predetermined configuration that causes each additional playing piece to be engaged with said target with greater difficulty by said player due to the presence of previously-directed playing pieces engaged with said target, wherein each additional playing piece engaged with said target contacts one previously directed playing piece engaged with said target.

* * * * *